US005750298A

United States Patent [19]

Kanbayashi et al.

[11] Patent Number: 5,750,298

[45] Date of Patent: May 12, 1998

[54] YELLOW TONER FOR DEVELOPING ELECTROSTATIC IMAGE, TWO COMPONENT DEVELOPER, IMAGE SHEET

[75] Inventors: Makoto Kanbayashi, Kawasaki; Ryoichi Fujita, Tokyo, both of Japan

[73] Assignee: Canon Kabushiki Kaisha, Tokyo, Japan

[21] Appl. No.: 815,921

[22] Filed: Mar. 13, 1997

[30] Foreign Application Priority Data

Mar. 15, 1996 [JP] Japan ..... 8-059140
Dec. 6, 1996 [JP] Japan ..... 8-326779

[51] Int. Cl.[6] ..... G03G 9/09

[52] U.S. Cl. ..... 430/45; 430/106

[58] Field of Search ..... 430/45, 106, 110

[56] References Cited

U.S. PATENT DOCUMENTS

| | | | |
|---|---|---|---|
| 4,865,650 | 9/1989 | von der Crone et al. | 106/494 |
| 5,354,640 | 10/1994 | Kanbayashi et al. | 430/110 |
| 5,437,949 | 8/1995 | Kanbayashi et al. | 430/45 |
| 5,558,967 | 9/1996 | Nagatsuka et al. | 430/106.6 |
| 5,578,407 | 11/1996 | Kasuya et al. | 430/106 |
| 5,604,071 | 2/1997 | Okado et al. | 430/110 |
| 5,607,806 | 3/1997 | Kanbayashi et al. | 430/110 |
| 5,620,824 | 4/1997 | Okado et al. | 430/106.6 |

FOREIGN PATENT DOCUMENTS

| | | | |
|---|---|---|---|
| 63-161062 | 7/1988 | Japan | C09B 67/20 |
| 5-19535 | 1/1993 | Japan | G03G 9/09 |

*Primary Examiner*—John Goodrow
*Attorney, Agent, or Firm*—Fitzpatrick, Cella, Harper & Scinto

[57] ABSTRACT

A yellow toner for developing an electrostatic image contains yellow color toner particles having at least a binder resin and a yellow colorant, and an external additive. The binder resin has a polyester resin having an acid value of from 2 mg KOH/g to 25 mg KOH/g and a glass transition temperature of from 52° C. to 65° C. The yellow colorant is a compound represented by the following Formula (I):

(I)

;

The external additive is composed of a fine titanium oxide powder or fine aluminum oxide powder subjected to hydrophobic treatment. The powder has an average primary particle diameter of from 0.01 μm to 2 μm. The yellow toner has a weight average particle diameter of from 3.0 μm to 15.0 μm.

49 Claims, 2 Drawing Sheets

YELLOW TONER FOR DEVELOPING ELECTROSTATIC IMAGE, TWO COMPONENT DEVELOPER, IMAGE SHEET

BACKGROUND OF THE INVENTION

1. Field of the Invention

This invention relates to a yellow toner for developing an electrostatic image, used to develop an electrostatic image in electrophotography, electrostatic recording or electrostatic printing. It also relates to a two-component developer having this yellow toner, and an image sheet having a color image formed using the yellow toner.

2. Related Background Art

With the recent spread of computer machinery intended for personal users, full-color picture communication is widely permeating as a picture-supported information transmission system. Under such circumstances, printers or copying machines as one of output machinery are rapidly made adapted to full-color display, chiefly aiming at low-class machines as a commercial target. Accordingly, color images are becoming more popular also to common users.

Such full-color output machinery commonly includes many systems such as an electrophotographic system, a thermal transfer system, an ink-ribbon recording system and an ink-jet recording system. Stated generally, the electrophotographic system is a a system in which an electrostatic latent image is formed on a photosensitive member making use of a photoconductive material, and subsequently developing the latent image by the use of a toner to from a toner image. The toner image is transferred to a transfer medium such as paper, if necessary, followed by fixing by a fixing means such as heating, pressing, heating and pressing or solvent vapor, thus a color image is obtained.

In the case of full-color electrophotography, colors are reproduced using three color toners corresponding to the three primary colors of coloring matter, yellow, magenta and cyan colors, or using four color toners having a black toner in addition to these. For example, light reflected from an original is transmitted through a color-separating light-transmitting filter having the relation of complimentary color to the color of a toner, to form an electrostatic latent image for magenta on a photoconductive layer (a latent-image forming step). Next, using a magenta toner, a developing step and a transfer step are carried out, through which a color toner image is held on a support. Subsequently, these steps are successively repeated plural times using a cyan toner, a yellow toner and a black toner, to superimpose color toner images on the same support while bringing registration into agreement, followed by fixing to obtain a final full-color image.

In general, when a toner is blended with a carrier and used as a two-component developer, the toner is electrostatically charged to have the desired charge quantity and charge polarity due to its friction against the carrier, and the electrostatic attraction force produced is utilized to develop electrostatic images. Accordingly, in order to obtain good visible images, the toner is chiefly required to have a good triboelectric chargeability.

To cope with such problems, a variety of researches are made, e.g., selection is made on carrier core materials and carrier coat materials, coating amount of carrier coating material is optimized, charge control agents and fluidity-providing agents to be added to toners are studied, and also binders serving as base materials are improved, all of which are made so that a better triboelectric chargeability can be achieved for the materials that constitute developers.

In recent years, a commercial demand is increasing for copying machines or printers satisfying higher minuteness and higher quality images. In the present technical field, it is attempted to make particle diameters of color toners smaller so that color images can be formed in a higher image quality. Making smaller the particle diameters of toner particles results in an increase in the surface area per unit weight, tending to bring about an excessively large quantity of triboelectricity of the toners, so that image density fall or running performance deterioration tends to occur. In addition, because of the large quantity of triboelectricity, toner particles may strongly adhere one another to cause a decrease in fluidity, bringing about a problem in the stability of supplying toner or imparting triboelectricity to toner.

In the case of color toners, they contain no conductive materials such as magnetic materials and carbon black, and hence, there is no portion from which charges leak and a quantity of triboelectricity tend to increase. This tendency is more remarkable when polyester type binders having a high charging performance are used.

In particular, color toners are strongly desired to have performances as shown below, (1) to (3).

(1) Fixed color toner images are required to nearly come into a substantially complete molten state to the extent that the form of toner particles can not be recognized, so that their color reproduction may not be hindered because of the irregular reflection of light.

(2) Color toners must have a transparency not to obstruct color tone of the color toner layer having a different color tone lying beneath an upper layer thereof.

(3) It is important for the respective color toners to have well-balanced hues and spectral reflection properties, and have sufficient chroma.

From such viewpoints, studies are made on many binder resins, and toners satisfying the above performances are long-awaited. Nowadays, in the present technical field, resins of a polyester type are widely used as binder resins for color toners. Toners comprised of a polyester resin, however, commonly tend to be affected by temperature and humidity, and tend to cause problems of an excessive charge quantity in a low humidity environment and an insufficient charge quantity in a high humidity environment. Thus, it is sought to bring out color toners having stable charge quantity over a wide range of environment.

Japanese Patent Application Laid-open No. 63-161062 (corresponding to U.S. Pat. No. 4,865,650) discloses a pigment composition basically composed of an isoindolinone pigment.

Japanese Patent Application Laid-open No. 5-19535 discloses a yellow toner for developing electrostatic images which contains a tetrachloro-isoindolinone type organic pigment as a coloring component. However, it is sought to more improve the reproducibility of flesh color, where full-color images are formed, and the transparency of projected images formed using an overhead projector (OHP).

SUMMARY OF THE INVENTION

An object of the present invention is to provide a yellow toner for developing an electrostatic image, which has solved the problems as discussed above.

Another object of the present invention is to provide a yellow toner for developing an electrostatic image, and a two-component developer, that can achieve fog-free and sharp image characteristics and also have a superior running (or operation) stability.

Another object of the present invention is to provide a yellow toner for developing an electrostatic image, and a two-component developer, having a superior fluidity and also having superior development fidelity and transfer performance.

Still another object of the present invention is to provide a yellow toner for developing an electrostatic image, and a two-component developer, which can be hardly affected by environmental variations in temperature and humidity and have always stable triboelectric chargeability.

A further object of the present invention is to provide a yellow toner for developing an electrostatic image, and a two-component developer, which have a good cleaning performance and may cause less filming, or contamination on photosensitive members.

A still further object of the present invention is to provide a yellow toner for developing an electrostatic image, and a two-component developer, having a superior fixing performance and also having a superior OHP transparency.

A still further object of the present invention is to provide a yellow toner for developing an electrostatic image, and a two-component developer, which can form color images substantially free of fading and having a superior light-fastness.

A still further object of the present invention is to provide an image sheet having color images substantially free of fading, having a superior light-fastness and also having a superior OHP transparency.

To achieve the above objects, the present invention provides a yellow toner for developing an electrostatic image, comprising yellow color toner particles having at least a binder resin and a yellow colorant, and an external additive, wherein;

the binder resin has a polyester resin having an acid value of from 2 to 25 mg KOH/g and a glass transition temperature of from 52° to 65° C.;

the yellow colorant has a compound represented by the following Formula (I):

(I)

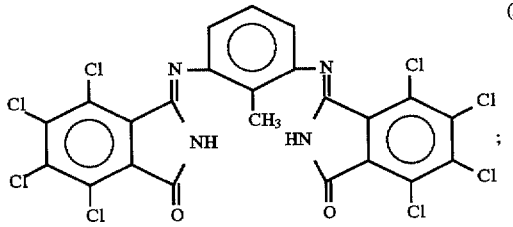

the external additive has a fine titanium oxide powder or fine aluminum oxide powder subjected to hydrophobic treatment, having an average primary particle diameter of from 0.01 to 2 μm; and the yellow toner has a weight average particle diameter of from 3 to 15 μm.

The present invention also provides a two-component developer comprising:

a yellow toner and a carrier;

the yellow toner comprising yellow color toner particles having at least a binder resin and a yellow colorant, and an external additive, wherein:

the binder resin has a polyester resin having an acid value of from 2 to 25 mg KOH/g and a glass transition temperature of from 52° to 65° C.;

the yellow colorant has a compound represented by the following Formula (I):

(I)

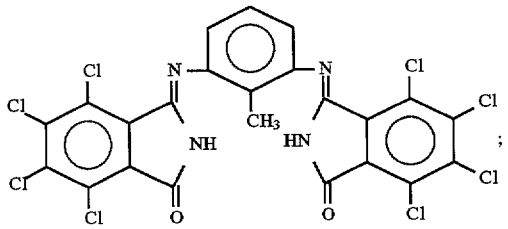

the external additive has a fine titanium oxide powder or fine aluminum oxide powder subjected to hydrophobic treatment, having an average primary particle diameter of from 0.01 to 2 μm;

the yellow toner has a weight average particle diameter of from 3 to 15 μm; and the carrier comprises magnetic carrier particles.

The present invention still also provides an image sheet comprising:

a recording sheet; and a color image formed on the recording sheet by fixing on the recording sheet a color toner image having at least a yellow toner;

the yellow toner comprising yellow color toner particles having at least a binder resin and a yellow colorant, and an external additive, wherein;

the binder resin has a polyester resin having an acid value of from 2 to 25 mg KOH/g and a glass transition temperature of 52° to 65° C.;

the yellow colorant has a compound represented by the following Formula (I):

(I)

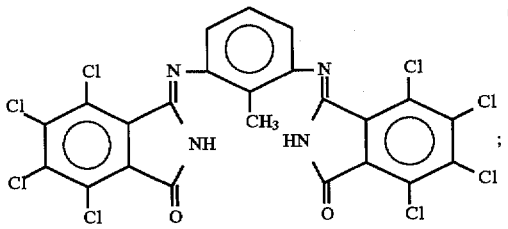

the external additive has a fine titanium oxide powder or fine aluminum oxide powder subjected to hydrophobic treatment, having an average primary particle diameter of from 0.01 to 2 μm; and the yellow toner has a weight average particle diameter of from 3 to 15 μm.

DESCRIPTION OF THE PREFERRED EMBODIMENTS

Figure 1:
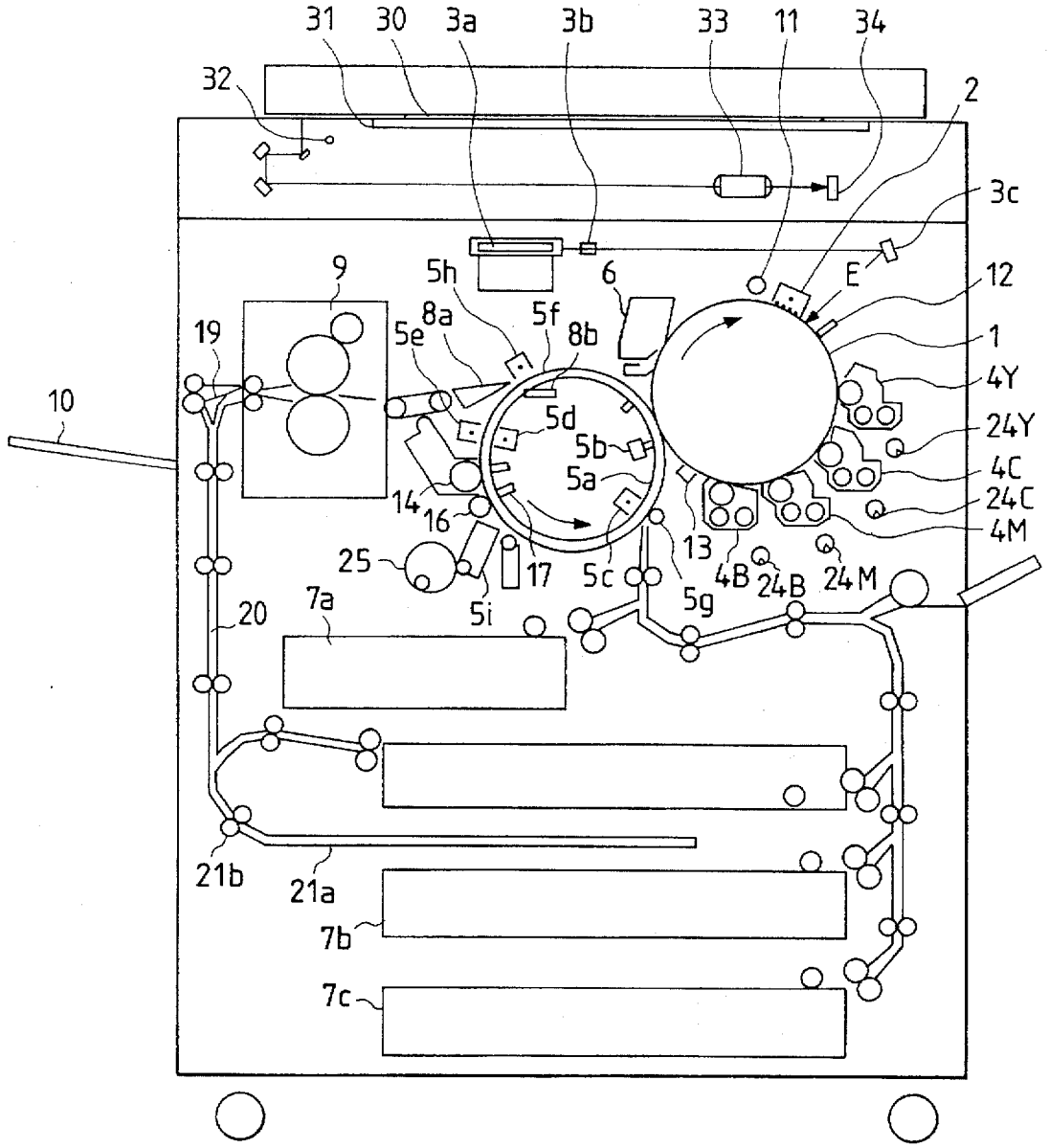
FIG. 1 is a schematic cross section showing an example of an image forming apparatus using the yellow toner of the present invention.

The present inventors has extensively researched on yellow colorants applicable to yellow toners, and discovered that a yellow toner having a good hue can be obtained by using as a yellow colorant a compound represented by the following Formula (I) (hereinafter "compound (I)"):

(I)

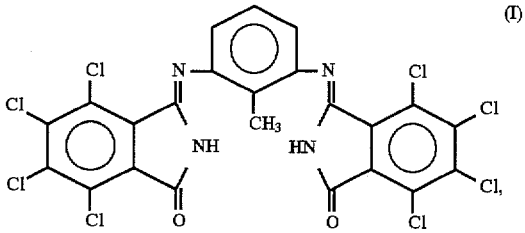

and also the above compound (I) is remarkably effective for stabilizing toner charging, especially, when a polyester resin is used as a binder resin.

The present invention will be described below in detail.

The above compound (I) used in the present invention may be produced by condensation reaction of a tetrachloroisoindolin-1-one represented by the following Formula (II), (III) or (IV), or a derivative thereof, with a diamine compound.

(II)

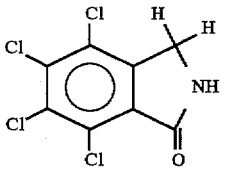

(III)

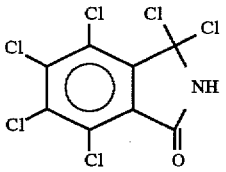

(IV)

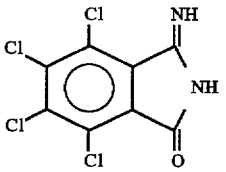

The compound (I) used in the present invention is a color pigment, has a good dispersibility in binder resins, and can prepare a yellow toner having a clear hue.

The compound (I) having the tetrachloroisoindolin-1-one structure has the function to stabilize the charge quantity of toner, prevents the quantity of triboelectricity of toner from becoming excessive in a low temperature and low humidity environment, and on the other hand, prevents the quantity of triboelectricity of toner from lowering in a high temperature and high humidity environment. The compound (I) is more remarkably effective especially when a polyester resin having an acid value is used as a binder resin. The reason is presumably as follows: Carboxyl groups or hydroxyl groups present at the terminals of the molecular chain of the polyester resin and imino groups and carbonyl groups in the isoindolinone skeleton possessed by the compound (I) partly combine through hydrogen bonds or combine electrostatically, so that (i) the absorption of water content in the carboxyl groups or hydroxyl groups present at the terminals of the molecular chain of the polyester resin is restrained and hence the quantity of triboelectricity of toner may be inhibited from lowering even in a high temperature and high humidity environment, and also (ii) polar groups such as carboxyl groups or hydroxyl groups present at the terminals of the molecular chain of the polyester resin decrease and hence the quantity of triboelectricity of toner can be inhibited from becoming excessive even in a low temperature and low humidity environment.

The yellow toner of the present invention, which contains the compound (I) and a specific polyester resin, also has an advantage that melt-adhesion of toner to the surface of a photosensitive member may hardly occur even in many-sheet running especially in a high temperature and high humidity environment.

The reason is presumably as follows:

In the compound (I), the connecting group is a phenylene group substituted with a methyl group, and hence the methyl group which is an electron-donating group makes higher the electron density of nitrogen atoms bonded to the carbon atoms at the ortho-position of the phenylene group. As the result, the reactivity of the imino groups in the isoindolinone skeleton of the compound (I) is raised as compared with a case where a hydrogen atom in the phenylene group is not replaced with a methyl group, so that the inter action between the compound (I) and the polyester resin is strengthened due to the hydrogen bonds or electrostatic combinations between the imino groups of the compound (I) and the carboxyl groups or hydroxyl groups present at the terminals of the molecular chain of the polyester resin, and hence the elasticity of toner increases to such an extent that the fixing performance of the toner is not deteriorated. Thus, the melt-adhesion of toner to the surface of a photosensitive member may hardly occur.

In addition, the yellow toner of the present invention containing the compound (I) as a yellow colorant (pigment) expresses a greenish yellow, has spectral characteristics preferred as a yellow toner for full-color image formation, and also has high brightness and chroma. The reproducibility of flesh color of humans is important for full-color images. The use of the yellow toner of the present invention, containing the compound (I), and enables the flesh color to be reproduced well. When the color images formed on an OHP sheet are projected using an overhead projector (OHP), they are excellent in their transparency.

A compound represented by the following Formula (V) (hereinafter "compound (V)":

(V)

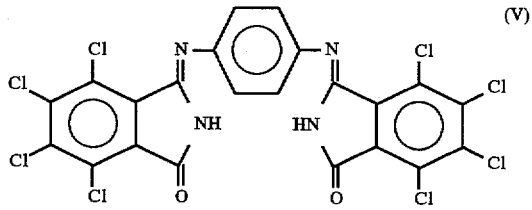

is a yellow pigment expressing a reddish tone when compared with the compound (I). When a yellow toner containing the compound (V) is used as a yellow toner for full-color image formation, the reproducibility of green hues becomes lower than the yellow toner containing the compound (I), to make it impossible to output green hues having a high chroma.

Moreover, the yellow toner of the present invention, containing the compound (I), can form color images substantially free of fading and having a superior light-fastness.

In the present invention, the yellow toner may contain the compound (I) in an amount of from 1 to 15 parts by weight, preferably from 3 to 12 parts by weight, and more preferably from 4 to 10 parts by weight, based on 100 parts by weight of the binder resin.

If the compound (I) is contained in an amount more than 15 parts by weight, the transparency may decrease and also the reproducibility of a neutral tint as typified by flesh color of humans tends to lower, and still also the stability of charging performance of the toner may lower, making it difficult to obtain the intended charge quantity.

If the compound (I) is contained in an amount less than 1 part by weight, the intended coloring power is difficult to obtain, and high-grade images having a high image density cannot be obtained.

In the present invention, a polyester resin is used as the binder resin. The polyester resin provides a good fixing performance when used as a binder resin of toners, and is suited for color toners.

The polyester resin has so strong a negative chargeability that toners tend to be charged excessively. However, as stated above, the disadvantages can be overcome when the compound (I) is used, and a good yellow toner can be obtained.

In particular, the following polyester resin is preferred because of its sharp melt properties. This polyester resin may be obtained by co-condensation polymerization of i) a diol component comprised of a bisphenol derivative or substituted bisphenol represented by the following Formula (VI):

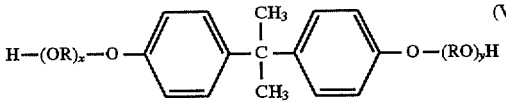

(VI)

wherein R represents an ethylene group or a propylene group, and each of x and y is an integer of 1 or more, where the average of x+y is 2 to 10; and ii) a polybasic carboxylic acid component selected from a dibasic or higher carboxylic acid, a dibasic or higher carboxylic anhydride and a lower alkyl ester of a dibasic or higher carboxylic acid, as exemplified by fumaric acid, maleic acid, maleic anhydride, phthalic acid, terephthalic acid, trimellitic acid and pyromellitic acid.

In the present invention, the polyester resin have an acid value of from 2 to 25 mg KOH/g, preferably from 3 to 22 mg KOH/g, and more preferably from 5 to 20 mg KOH/g. Such a polyester resins is preferable because a superior charging stability can be obtained in every environment.

If the polyester resin has an acid value smaller than 2 mg KOH/g, the toner is liable to cause charge-up, lowering image density in a low temperature and low humidity environment. Also, the dispersibility of the compound (I) in the resin tends to lower to cause a difference in charge quantity between toner particles, resulting in more or less fogging in running for a long time.

If the polyester resin has an acid value greater than 25 mg KOH/g, the charging stability with time of the toner may lower and cause a decrease in charge quantity with running, and faulty images such as toner scatter and fog may occur, especially, in a high temperature and high humidity environment.

If the polyester resin has an acid value greater than 25 mg KOH/g, the water absorption may be difficult to inhibit even when the compound (I) is mixed with the toner.

In the present invention, taking into account the storage stability and fixing performance of the yellow toner and also its ability of making a color mixture with other color toners, the polyester resing has preferably a glass transition temperature of from 52° to 65° C., and particularly from 53° to 64° C.

If the polyester resin has a glass transition temperature lower than 52° C., fixing performance may be good, but anti-offset properties may be lowered so that contamination on fixing rollers or winding around a fixing roller is lible to occur. Also, images obtained after fixing is too glossy, resulting in deterioration in image quality. Thus, such a polyester resin is not preferable.

If the polyester resin has a glass transition temperature higher than 65° C., fixing performance may be so poor that the fixing temperature of the copying machine main body must be set higher, and the images obtained may commonly have a low gloss, also resulting in deterioration in color mixing performance (or the ability of making a color mixture) when used as a toner for full-color formation.

The polyester resin used in the present invention may have a number average molecular weight (Mn) of preferably from 1,500 to 50,000, and more preferably form 2,000 to 20,000, a weight average molecular weight (Mw) of preferably from 6,000 to 100,000, and more preferably from 10,000 to 90,000, and Mw/Mn of preferably from 2 to 8. The polyester resin that fulfills the above conditions has a good heat fixing performance, improves the dispersibility of the colorant, and allows the variation in the electrification quantity of the yellow toner to become less, so that the reliability of the image quality is raised.

If the polyester resin has a number average molecular weight (Mn) less than 1,500 or a weight average molecular weight (Mw) less than 6,000, the surfaces of fixed images may be highly smooth and look clear in either case, but offset tends to occur during running, and also the storage stability of the toner may be deteriorated, raising anxiety about other problems concerning melt-adhesion of toner to the inside of developing assemblies or the carrier-spent which is caused by adhesion of toner components to carrier surfaces. In addition, when toner materials are melt-kneaded in the production of yellow color toner particles, shear is difficult to apply and the dispersibility of the yellow colorant may be deteriorated, lowering the coloring power of the toner or varying the charge quantity.

If the polyester resin has a number average molecular weight (Mn) more than 50,000 or a weight average molecular weight (Mw) more than 100,000, the toner may have good anti-offset properties in either case, but the fixing temperature must be set higher. Moreover, even if the dispersion degree of the pigment is controlled, surface smoothness at image areas is lowered, and color reproducibility may be deteriorated.

If the polyester resin has Mw/Mn less than 2, the resulting polyester resin commonly is small in its molecular weight. Hence, like the above case where it has a low molecular weight, offset is liable to occur during running, the storage stability of the toner may be lowered, and melt-adhesion of toner may occur in developing assemblies and toner components adhere to carrier surfaces to cause the carrier-spent. Moreover, the charge quantity of the toner is liable to vary.

If the polyester resin has Mw/Mn more than 8, the toner may be good in anti-offset properties, but the fixing temperature must be set higher. Moreover, even if the dispersion degree of the pigment is controlled, surface smoothness at image areas is lowered, and color reproducibility may be deteriorated.

The compound (I) used in the present invention, compared with the same compounds but no chlorine substituents, is effective for stabilizing negative chargeability of toner, and also is more remarkably effective when used as the binder resin in combination with the polyester resin having a high negative chargeability, so that much higher image quality and good durability in copying or printing many sheets can be achieved.

The yellow toner of the present invention may optionally contain a charge control agent. The charge control agent used in the present invention includes metal compounds of aromatic carboxylic acid derivatives, preferably, salicylic acid metal salts, salicylic acid metal complexes, alkylsalicylic acid metal salts, alkylsalicylic acid metal complexes, dialkylsalicylic acid metal salts, and dialkylsalicylic acid metal complexes. As the metal elements, chromium, aluminum and zinc are preferred. The metal compounds of aromatic carboxylic acid derivatives is preferably colorless, white or light-colored.

When such a charge control agent is contained in the yellow color toner particles, it may be contained in an amount ranging preferably from 3% by weight to 10% by weight, and more preferably from 4% by weight to 8% by weight, based on the weight of the yellow color toner particles. However, the amount of the charge control agent is not necessarily limited thereto so long as it does not affect the color tone of the yellow toner.

The use of the charge control agent in the above-mentioned amount is preferred because the yellow toner is less in its charge quantity variation at the initial stage, and the absolute charge quantity necessary at the time of development can be readily obtained, so that the deterioration in image quality, e.g., "fogging" and image density fall, is not caused.

In the yellow toner of the present invention, it is possible to optionally add a lubricant such as a fatty acid metal salt (e.g., zinc stearate and aluminum stearate) or fine fluorine-containing polymer powder (e.g., fine powders of polytetrafluoroethylene, polyvinylidene fluoride and a tetrafluoroethylene-vinylidene fluoride copolymer), and a electroconductivity-imparting agent such as tin oxide or zinc oxide.

In the present invention, the yellow color toner particles may preferably contain a release agent. The release agent includes, e.g., aliphatic hydrocarbon waxes, oxides of aliphatic hydrocarbon waxes, ester waxes, and waxes chiefly composed of fatty esters, saturated straight-chain fatty acids, unsaturated fatty acids, saturated alcohols, polyhydric alcohols, fatty acid amides, saturated fatty acid bisamides, unsaturated fatty acid amides or aromatic bisamides.

The release agent may be contained in the yellow color toner particles in an amount of preferably from 0.1 to 20 parts by weight, and more preferably from 0.5 to 10 parts by weight, based on 100 parts by weight of the binder resin.

If the release agent is contained in an amount more than 20 parts by weight, anti-blocking properties and anti-offset properties at high-temperature may be deteriorated. If its amount is less than 0.1 part by weight, the release effect is not sufficiently exhibited.

In usual instances, the release agent may preferably be incorporated in the binder resin by a method in which the binder resin is dissolved in a solvent and, after raising resin solution temperature, the release agent is added while stirring the solution, or by a method in which the release agent is added at the time of melt-kneading toner constituent materials having at least the binder resin and the colorant.

In the production of the yellow color toner particles, the following methods can be employed: a method in which toner constituent materials are well kneaded by using a heat kneader such as a heat roll, a kneader or an extruder, thereafter the kneaded product is mechanically pulverized and the pulverized product is classified to obtain the toner; or a method in which toner constituent materials such as the colorant other than the binder resin are dispersed in a binder resin solution, followed by spray drying to obtain the toner.

In the present invention, the yellow toner may have a weight average particle diameter (D4) of from 3.0 μm to 15.0 μm, and preferably from 4.0 μm to 12.0 μm.

If the yellow toner has a weight average particle diameter (D4) smaller than 3.0 μm, the charging stability may be insufficient, resulting in fogging or toner scattering in many-sheet running.

If the yellow toner has a weight average particle diameter (D4) larger than 15.0 μm, reproducibility of halftone areas is greatly deteriorated, resulting in coarse images.

The yellow toner of the present invention may also have a volume average particle diameter (Dv) of from 2.5 μm to 6.0 μm. This is preferred in order to form images with a higher image quality.

If the yellow toner has a volume average particle diameter (Dv) smaller than 2.5 μm, the charging stability of the toner may be deteriorated. If larger than 6.0 μm, coarse images may be formed.

In the yellow toner of the present invention, as a fluidity improver, fine titanium oxide powder or fine aluminum oxide powder subjected to hydrophobic treatment, having an average primary particle diameter of from 0.01 to 2 μm, may be externally added to the yellow color toner particles.

The fluidity improver as an external additive is required not only to improve the fluidity of the yellow toner, but also not to harm the chargeability of the yellow toner.

Accordingly, it is preferable for the fine titanium oxide powder or fine aluminum oxide powder to have been subjected to hydrophobic treatment, whereby it is possible to simultaneously satisfy the requirements of imparting fluidity and stabilizing charge.

The fine titanium oxide powder or fine aluminum oxide powder has been subjected to hydrophobic treatment, and hence, can eliminate the influence of the water content which is a factor to affect the charge quantity, and reduce the difference in the charge quantity between a high humidity environment and a low humidity environment, to make it possible to improve environmental stability of the yellow toner. Further, primary particles can be inhibited from agglomerating in the course of hydrophobic treatment, so that an external additive less causative of secondary agglomeration can impart more uniform charges to the yellow toner.

In the present invention, fine titanium oxide powder or fine aluminum oxide powder subjected to hydrophobic treatment and having an average primary particle diameter of from 0.01 to 0.2 μm is particularly preferred because it has a good fluidity, can make uniform the charging of negatively chargeable yellow toners, so that toner scattering and fogging hardly occur. The power is hardly embeded in the surfaces of the yellow color toner particles to hardly cause a deterioration in the toner, bringing about an improvement in durability in many-sheet running. This tendency is more remarkable in the case of sharp-melting color toners.

If the fine titanium oxide powder or fine aluminum oxide powder subjected to hydrophobic treatment has an average primary particle diameter smaller than 0.01 μm, the treated fine powder may be imbeded in the surface of the yellow color particle and durability in the toner may be deteriorated earlier. This tendency is more remarkable in the case of sharp-melting color toners.

If the fine titanium oxide powder or fine aluminum oxide powder subjected to hydrophobic treatment has an average primary particle diameter larger than 2 μm, its fluidity may be lowered and the charging of the yellow toner is liable to be uneven, resulting in toner scattering and fogging, so that toner images with a high image quality may be difficult to form.

In the yellow toner of the present invention, the fine titanium oxide powder or fine aluminum oxide powder subjected to hydrophobic treatment may preferably be contained in an amount of from 0.5 to 5.0% by weight, more preferably from 0.7 to 3.0% by weight, and still more preferably from 1.0 to 2.5% by weight, based on the weight of the yellow toner. The yellow toner satisfying the above range has a good fluidity, can maintain a stable charge quantity and may hardly cause toner scattering.

If the fine titanium oxide powder or fine aluminum oxide powder subjected to hydrophobic treatment is contained in the yellow toner in an amount less than 0.5% by weight, fluidity of the toner is so insufficient that its blending properties with a carrier may be lowered, causing fogging and toner scattering on copying or printing many sheets.

If the fine titanium oxide powder or fine aluminum oxide powder subjected to hydrophobic treatment is contained in the yellow toner in an amount more than 5.0% by weight, fine powder is liable to be released from the surfaces of toner particles, bringing about the filming on the surface of a photosensitive member, faulty cleaning, or toner scattering and fogging.

The yellow toner of the present invention may be blended with magnetic carrier particles as a carrier, when used as a two-component developer.

The carrier used in the two-component developer of the present invention includes, e.g., magnetic particles of a material selected from the group consisting of magnetic metals such as iron, nickel, copper, zinc, cobalt, manganese, chromium and rare earth elements, magnetic alloys thereof, magnetic oxides thereof and magnetic ferrites thereof, the surface of which is oxidized or not oxidized.

The carrier may be a coated carrier having the above-mentioned magnetic particles as carrier cores whose surfaces are coated with a coating agent. In this coated carrier, as methods for coating the carrier core surfaces with a coating agent, known methods may be used, e.g., a method in which a coating agent is dissolved or suspended in a solvent and the resulting solution or suspension is applied and adhered to the carrier cores. Or a method in which carrier cores and a coating agent are merely mixed in a powdery state.

As the coating agent for the carrier cores, a coating resin is used. The coating resin includes polytetrafluoroethylene, monochlorotrifluoroethylene polymer, polyvinylidene fluoride, silicone resins, polyester resins, styrene resins, acrylic resins, polyamides, polyvinyl butyral, and aminoacrylate resins. Each of the above polymers may be used alone or in combination with some of these.

A suitable amount of the above coating agent to be used in the above treatment may be optionally determined, but it is preferably from 0.1 to 30% by weight, and more preferably from 0.5 to 20% by weight, based on the total weight of the carrier.

The carrier used in the present invention may preferably have an average particle diameter of from 10 to 100 μm, and more preferably from 20 to 70 μm.

If the carrier has an average particle diameter smaller than 10 μm, the packing of the two-component developer may increase to deteriorate lower blending properties of the toner with the carrier so that the chargeability of the toner may be unstable, and the carrier may be adhered to the drum surface of a photosensitive member.

If the carrier has an average particle diameter larger than 100 μm, contact frequency with the toner may be lowered, so that a toner with a low charge quantity may be mixed to cause fogging. Toner scattering also tends to occur, and hence the toner concentration in the two-component developer must be set a little lower, so that images with a high image density cannot be formed.

A particularly preferred carrier is a coated magnetic carrier comprising magnetic core particles such as magnetic ferrite core particles whose surfaces are coated with a coating resin such as a silicone resin, a fluorine resin, a styrene resin, an acrylic resin or a methacrylic resin in an amount of preferably from 0.01 to 5% by weight, and more preferably from 0.1 to 1% by weight, containing at least 70% by weight of carrier particles of 250-mesh-pass and 400-mesh-on (i.e. passing through 250-mesh and staying on 400-mesh), and the particle size distribution of which has been controlled so as to have the average particle diameter described above.

The coated magnetic carrier, when having a sharp particle size distribution, can impart a preferable triboelectric chargeability to the yellow toner of the present invention and also can be effective for improving electrophotographic performance.

In the case where the yellow toner is blended with the carrier to prepare a two-component developer, good results can be obtained when they are blended in such a proportion that provides a toner concentration of from 2% by weight to 15% by weight, more preferably from 3% by weight to 13% by weight, and still more preferably from 4% by weight to 10% by weight, in the two-component developer. If the toner concentration is less than 2% by weight, image density tends to lower. If it is more than 15% by weight, fogging and in-machine toner scattering around the inside of a machine tend to occur, and the lifetime of the two-component developer may be shortened.

A method in which the yellow toner of the present invention is used to form a full-color image will be described below with reference to FIG. 1.

FIG. 1 schematically illustrates the constitution of an example of an image forming apparatus for forming full-color images by electrophotography. The image forming apparatus shown in FIG. 1 is used as a full-color copying machine or a full-color printer. The full-color copying machine has, as shown in FIG. 1, a digital color-image reader section at the top and a digital color-image printer section at a lower part.

In the image reader section, an original 30 is placed on an original-setting glass 31, and an exposure lamp 32 effects exposure scanning, whereby an optical image reflected from the original 30 is focused on a full-color sensor 34 through a lens 33 to obtain color separation image signals. The color separation image signals are processed by a video processing unit (not shown) through an amplifying circuit (not shown), and then forwarded to the digital color-image printer section.

In the image printer section, a photosensitive drum 1 as an image bearing member has a photosensitive layer having, e.g., an organic photoconductor, and is supported to freely rotate in the direction of an arrow. Around the photosensitive drum 1, a pre-exposure lamp 11, a corona charging assembly 2, a laser exposure optical system 3, a potential sensor 12, four different color developing assemblies 4Y, 4C, 4M and 4K, a detecting means 13 for detecting an quantity of light on the drum, a transfer member 5 and a cleaner 6 are provided.

In the laser exposure optical system, the image signals sent from the reader section are converted into optical signals for image scanning exposure at a laser output part (not shown), and the laser light thus converted is reflected on a polygonal mirror **3*a* and projected on the surface of the photosensitive drum 1 through a lens 3*b* and a mirror 3*c***.

In the printer section, the photosensitive drum 1 is rotated in the direction of the arrow at the time of image formation.

The photosensitive drum 1 is, after eliminating the electrification by the pre-exposure lamp 11, uniformly charged negatively by means of the charging assembly 2, and then irradiated with an optical image E for each separated color to form an electrostatic image on the photosensitive drum 1.

Next, a certain developing assembly is operated to develop the electrostatic image formed on the photosensitive drum 1, forming a toner image on the photosensitive drum 1 by the use of a toner. The developing assemblies 4Y, 4C, 4M and 4K alternatively come close to the photosensitive drum 1 in accordance with the individual separated colors by the operation of eccentric cams 24Y, 24C, 24M and 24K, respectively, to perform development.

The transfer member has a transfer drum 5*a*, a transfer charging assembly 5*b*, an attraction charging assembly 5*c* for electrostatically attracting a transfer medium serving as a recording medium, and an attraction roller 5*g* provided opposite to the assembly 5*c*, an inside charging assembly 5*d*, an outside charging assembly 5*e* and a separation charging assembly 5*h*. The transfer drum 5*a* is supported on a shaft so that it can be rotatably driven, and has a transfer sheet 5*f* serving as a transfer medium holding member that holds the transfer medium at an open zone on the periphery thereof, the transfer sheet being adjusted on a cylinder in one united body. As the transfer sheet 5*f*, a resin film such as polycarbonate film is used.

The transfer medium is transported from a cassette 7*a*, 7*b* or 7*c* to the transfer drum 5*a* through a transfer sheet transport system, and is held on the transfer drum 5*a*. With the rotation of the transfer drum 5*a*, the transfer medium held on the transfer drum 5*a* is repeatedly transported to the transfer position facing the photosensitive drum 1. In the process of passing through the transfer position, the toner image formed on the photosensitive drum 1 is transferred to the transfer medium by the action of the transfer charging assembly 5*b*.

The toner image is, as shown in FIG. 1, directly transferred from the photosensitive member to the transfer medium. Alternatively, the toner image on the photosensitive member may be once transferred to an intermediate transfer member and then transferred from the intermediate transfer member to the transfer medium.

The above steps of image formation are repeatedly carried out on yellow (Y), magenta (M), cyan (C) and black (K), thus a color image formed by superimposing four color toner images is obtained on the transfer medium held on the transfer drum 5*a*.

The transfer medium to which the four color toner images have been thus transferred is separated from the transfer drum Sa by the action of a separation claw 8*a*, a separation push-up roller 8*b* and the separation charging assembly 5*h*, and sent to a heat-pressing fixing assembly, where the toner images are fixed by heating and pressing and thereby the color mixing of the toners, color formation, and fixing to the transfer medium are carried out until a full-color fixed image is formed. Thereafter, the transfer medium having the image thus formed is outputted to a tray 10. Thus, the formation of a full-color image is completed. Meanwhile, the photosensitive drum 1 is cleaned by the cleaner 6 so that toners remaining on its surface are removed, and thereafter again placed at the service of the steps of image formation. As a cleaning member, a blade may be used, or a fur brush or a nonwoven fabric, or a combination of any of these, may be used.

Around the transfer drum 5*a*, an electrode roller 14 and a fur brush 15 which face each other while the transfer sheet 5*f* is interposed therebetween, as well as an oil removing roller 16 and a back-up brush 17 which face each other while the transfer sheet 5*f* is interposed therebetween, are provided to perform cleaning in order to remove any powder adhering to the surface of the transfer sheet 5*f* on the transfer drum 5*a* and any oil adhering to the surface of the transfer sheet 5*f*. Such cleaning is performed before or after the image formation, and at any time jamming or paper blocking has occurred.

An eccentric cam 25 is operated at desired timing to actuate a 29-degree cam follower 5*i* associated with the transfer drum 5*a*, whereby the gap between the transfer sheet 5*f* and the photosensitive drum 1 can be set as desired. For example, on stand-by or when the switch is turned off, a space can be kept between the transfer drum 5*a* and the photosensitive drum 1.

Full-color images are formed using the image forming apparatus described above. In the above image forming apparatus, monochromatic fixed images or multi-color fixed images can be formed by selecting either a monochromatic mode or a multi-color mode.

Through the image forming process as described above, the image sheet of the present invention can be obtained which comprises a recording sheet and a color image formed on the recording sheet by fixing on the recording sheet a color toner image having at least the yellow toner of the present invention.

Various physical properties are measured by the methods as described below.

Measurement of particle size distribution of toner:

As a measuring device, a Coulter counter Model TA-II or Coulter Multisizer (manufactured by Coulter Electronics, Inc.) is used. As an electrolytic solution, an aqueous 1% NaCl solution is prepared using first-grade sodium chloride. For example, ISOTON R-II (trade name, Coulter Multisizer, manufactured by Coulter Scientific Japan Co.) may be used. Measurement is carried out by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for from about 1 minute to about 3 minutes in an ultrasonic dispersion machine. The volume distribution and number distribution of the toner are calculated by measuring the volume and number of toner particles by means of the above measuring device, using an aperture of 100 μm as its aperture. Then the weight-based, weight average particle diameter (D4) determined from the volume distribution of toner particles and the volume-based, volume average particle diameter (Dv) (the middle value of each channel is used as the representative value for each channel) are determined.

As channels, 13 channels are used, which are of 2.00 to 2.52 μm, 2.52 to 3.17 μm, 3.17 to 4.00 μm, 4.00 to 5.04 μm, 5.04 to 6.35 μm, 6.35 to 8.00 μm, 8.00 to 10.08 μm, 10.08 to 12.70 μm, 12.70 to 16.00 μm, 16.00 to 20.20 μm, 20.20 to 25.40 μm, 25.40 to 32.00 μm, and 32.00 to 40.30 μm.

Measurement of glass transition point of polyester resin:

In the present invention, glass transition point is measured using a differential thermal analyzer (DSC measuring device, DSC-7, manufactured by Perkin Elmer Co.).

A sample for measurement is precisely weighed in an amount of from 5 to 20 mg, and preferably 10 mg. This sample is put in a pan made of aluminum and an empty aluminum pan is set as reference. Measurement is carried out in a normal temperature and normal humidity environment at a rate of temperature rise of 10° C./min within the measuring temperature range of from 30° to 200° C.

In the course of this temperature rise, an endothermic peak of a main peak in the temperature range of from 40° to 100° C. is obtained.

The point at which a line connecting middle points of the base lines before and after the endothermic peak appears and a differential thermal curve cross each other, is regarded as glass transition temperature Tg. Measurement of molecular weight of polyester resin:

The Mn, Mw and Mw/Mn of the polyester resin are measured by gel permeation chromatography (GPC). Columns are stabilized in a heat chamber of 40° C. To the columns kept at this temperature, tetrahydrofuran (THF) as a solvent is allowed to flow at a flow rate of 1 ml per minute, and about 100 μl of THF sample solution is injected thereinto to carry out the measurement. In measuring the molecular weight of the sample, the molecular weight distribution possessed by the sample is calculated from the relationship between the logarithmic value and count number of a calibration curve prepared using several kinds of monodisperse polystyrene standard samples. As the standard polystyrene samples used for the preparation of the calibration curve, it is suitable to use samples with molecular weights of from $10^2$ to $10^7$, which are available from Toso Co., Ltd. or Showa Denko K.K., and using at least about 10 standard polystyrene samples. An RI (refractive index) detector is used as a detector. It is preferred the columns are used in combination of a plurality of commercially available polystyrene gel columns. For example, they may preferably comprise a combination of Shodex GPC KF-801, KF-802, KF-803, KF-804, KF-805, KF-806, KF-807 and KF-800P, available from Showa Denko K.K.; or a combination of TSKgel G1000H($H_{XL}$), G2000H($H_{XL}$), G3000H($H_{XL}$), G4000H($H_{XL}$), G5000H($H_{XL}$), G6000H($H_{XL}$), G7000H ($H_{XL}$) and TSK Guard Column, available from Toso Co., Ltd.

The sample is prepared in the following way.

Sample resin is put in tetrahydrofuran (THF), which is then left to stand for several hours, followed by thorough shaking to well mix the resin with THF (until no sample mass can be seen), and the mixture is left to stand still for at least 12 hours. Here, the time of standing in THF is set to be at least 24 hours. Thereafter, the mixture is passed through a sample-treating filter (pore size: 0.45 to 0.5 μm; for example, MAISHORI DISK H-25-5, available from Toso Co., Ltd., or EKIKURO DISK 25CR, available from German Science Japan, Ltd., may be used). The solution obtained is used as the sample for GPC. The concentration of the sample is controlled to be from 0.5 to 5 mg/ml as the resin component.

Measurement of acid value:

In a 200 to 300 ml Erlenmeyer flask, a resin sample 2 to 10 g is weighed and put, followed by addition of about 50 ml of a 30:70 mixed solvent of methanol and toluene to dissolve the resin. If it can not be well dissolved, acetone may be added in a small amount. Using 0.1% by weight of mixed reagent of Bromothymol Blue and Phenol Red, titration is carried out in a N/10 potassium hydroxide-alcohol solution previously standardized, and the acid value is calculated from the consumption of the solution according the following expression:

$$\text{Acid value}=\text{KOH (ml)}\times N\times 56.1/\text{sample weight}$$

wherein N represents a factor of N/10 KOH.

Figure 2:
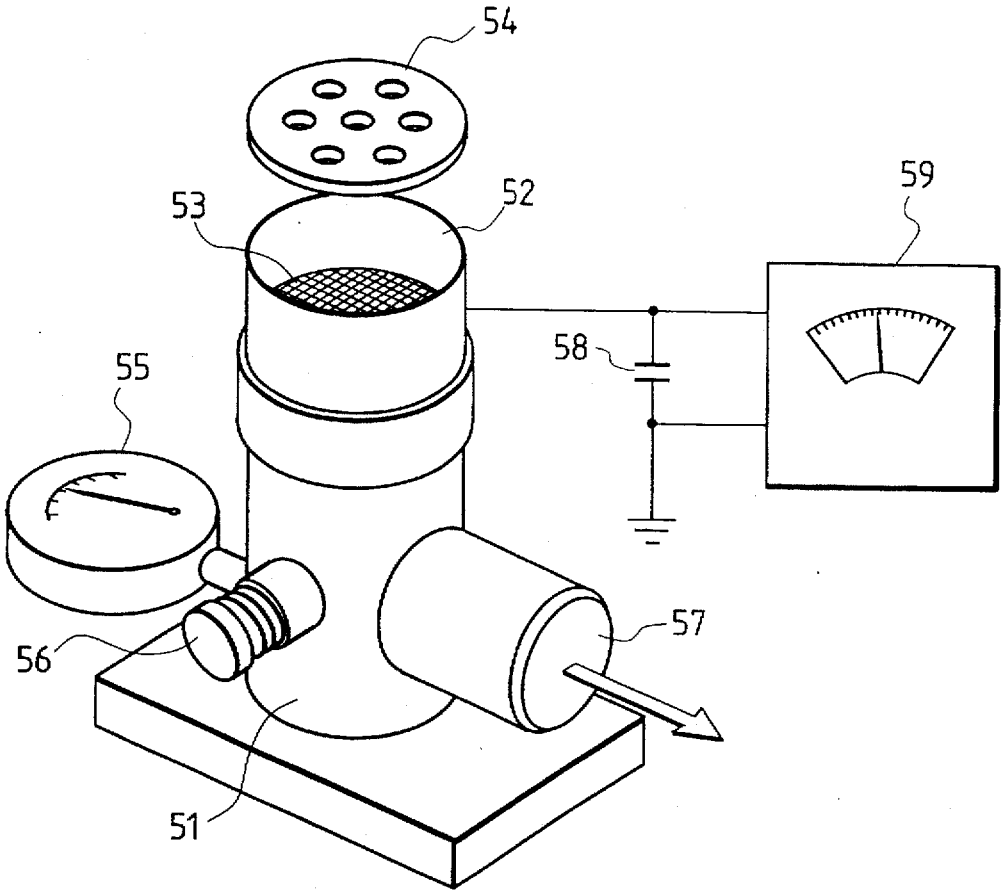
FIG. 2 is a schematic illustration of a device for measuring the quantity of triboelectricity of toners and external additives.

Measurement of quantity of triboelectricity:

FIG. 2 illustrates a device for measuring a quantity of triboelectricity. First, a mixture of a sample to be measured and a carrier, more specifically, in the case of a toner, a 1:19 mixture (weight ratio) of a toner and a carrier, and in the case of the external additive, a 1:99 mixture, is put in a 50 to 100 ml bottle made of polyethylene, and manually shaked for 5 to 10 minutes. About 0.5 to 1.5 g of the mixture (developer) thus obtained is put in a measuring container 52 made of metal at the bottom of which a 500-mesh conductive screen 53 of is provided, and the container is covered with a plate 54 made of metal. The total weight of the measuring container 52 at this time is weighed and is expressed as $W_1$ (g). Next, in a suction device 51 (made of an insulating material at least at the part coming into contact with the measuring container 52), air is sucked from a suction opening 57 and an air-flow control valve 56 is operated to control the pressure indicated by a vacuum indicator 55, to be 250 mmAq. In this state, suction is well carried out, preferably for 2 minutes, to remove the toner by suction. The potential indicated by a potentiometer 59 at this time is expressed as V (volt). Herein, the numeral 58 denotes a capacitor, whose capacitance is expressed as C (mF). The total weight of the measuring container after the suction is also weighed and is expressed as $W_2$ (g). The quantity of triboelectricity (mC/kg) of the toner is calculated as shown by the following expression.

$$\text{Quantity of triboelectricity (mC/kg) of sample}=(C\times V)/(W_1-W_2)$$

(Measurement conditions: 23° C., 60%RH)

As the carrier used in the measurement, a coated ferrite carrier having 70 to 90% by weight of carrier particles of 250 mesh-pass and 350 mesh-on is used. Measurement of average primary particle diameter of fine titanium oxide powder and fine aluminum oxide powder:

To measure primary particle diameter, particles of the fine titanium oxide powder or fine aluminum oxide powder are observed on a transmission electron microscope, and particle diameters of 300 particles not smaller than 0.005 μm, present in the visual field and enlarged to from 30,000 to 50,000 magnifications, are measured to determine their average particle diameter. Diameters of the particles dispersed on toner particles are observed using a scanning electron microscope, and 300 particles of the fine titanium oxide powder or fine aluminum oxide powder, present in the visual field and enlarged to from 30,000 to 50,000 magnifications, are qualitatively analyzed using an XMA (X-ray microanalyzer), where their particle diameters are measured to determine average particle diameter.

Measurement of average particle diameter of carrier:

Particle diameters of the carrier are measured using a micro-track particle size analyzer, SRA Type (manufactured by Nikkiso K.K.), with a measurement range being set in 0.7 μm to 700 μm. In the present invention, a 50% particle diameter of the carrier thus measured is regarded as the average particle diameter.

The yellow toner of the present invention employs the specific polyester resin as a binder resin, and the fine titanium oxide powder or fine aluminum oxide powder subjected to hydrophobic treatment, having the specific average primary particle diameter, is externally added to the yellow color toner particles containing as a yellow colorant the compound (I) previously described which is a tetrachloroisoindoline derivative. Hence, (i) the quantity of triboelectricity of toner can be inhibited from lowering in a high temperature and high humidity environment and also the quantity of triboelectricity of toner can be inhibited from becoming excessive in a low temperature and low humidity environment, exhibiting a superior environmental stability, (ii) the melt-adhesion to, and contamination of, the photosensitive member may hardly occur especially in a high temperature and high humidity environment, (iii) the fixed yellow images may hardly fade and have a superior light-fastness, and (iv) when used in full-color image formation and mixed with other color toners, the yellow toner can form images having high brightness and chroma and having good color reproducibility.

EXAMPLES

The present invention will be described below in greater detail by giving Examples.

Example 1

| | |
|---|---|
| Polyester resin No.1 (condensation polymer of propoxylated bisphenol-A with fumaric acid; acid value: 10.8 mg KOH/g; Tg: 58° C.; Mw: 9,000; Mn: 4,000; Mw/Mn: 2.25)) | 100 parts |
| Negative charge control agent (chromium compound of di-tert-butylsalicylic acid) | 4 parts |
| Compound (I) shown below | 5 parts |

(I)

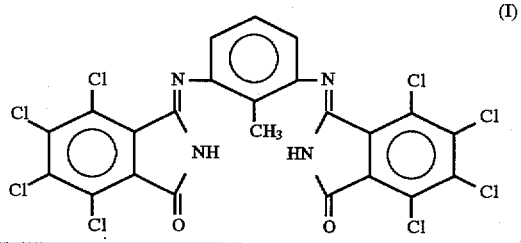

The above materials were thoroughly pre-mixed by means of a Henschel mixer, and then melt-kneaded using a twin-screw extruder. After cooled, the kneaded product was crushed using a hammer mill into coarse particles of about 1 to 2 mm in diameter, which were then finely pulverized using a fine grinding mill in an air-jet system. The resulting finely pulverized product was classified by means of a multi-division classifier while strictly removing fine powder and coarse powder at the same time, obtaining yellow color toner particles with a weight average particle diameter of 8.0 μm.

Meanwhile, as an external additive (fluidity improver and charge stabilizing agent), 100 parts by weight of hydrophilic fine titanium oxide powder (average primary particle diameter: 0.02 μm; BET specific surface area: 140 $m^2/g$) was subjected to surface treatment with 20 parts by weight of $n\text{-}C_4H_9\text{-}Si(OCH_3)_3$, obtaining hydrophobic fine titanium oxide powder A having an average primary particle diameter of 0.02 μm and a hydrophobicity of 70%.

100 parts by weight of the yellow color toner particles and 1.5 parts by weight of the hydrophobic fine titanium oxide powder A were mixed to produce yellow toner 1 comprising yellow color toner particles having on their surfaces fine titanium oxide particles.

The above yellow toner 1 and magnetic ferrite carrier particles (average particle diameter: 50 μm) surface-coated with silicone resin were blended so as to be in a toner concentration of 5% by weight, to produce a two-component yellow developer.

The two-component yellow developer thus obtained was put into a commercially available full-color copying machine (a color laser copying machine CLC700, manufactured by CANON, INC.) to make a copying test. As a result, the images obtained showed an image density as high as 1.7 to 1.8 even in a 50,000 sheet running (or copying) test made in a normal temperature and normal humidity environment (23° C., 60%RH). In respect of charging characteristics too, the developer was less in initial-stage variations and showed stable shifts between about −22 mC/kg and about −25 mC/kg.

On the drum surface of the photosensitive member after the 50,000 sheet running, any filming due to melt-adhesion of toner was not seen, and any faulty cleaning never occurred during the running.

During the 50,000 sheet running, any offset to the fixing roller did not occur at all. After the running, the surface of the fixing roller was visually observed, and none of contamination ascribable to the toner was seen.

After the 50,000 sheet running, the surfaces of the carrier in the developer were observed by SEM (scanning electron microscopy). As a result, almost no toner-spent was seen.

Also, 50,000 sheet running tests were made in an a high temperature and high humidity environment (30° C., 80%RH) and a low temperature and low humidity environment (15° C., 10%RH). As a result, neither fogging nor toner scattering occurred, and image density also shifted substantially stably. Moreover, on the drum surface of the photosensitive member after the running, any filming due to melt-adhesion of toner was not seen.

Next, the production of the yellow color toner particles was repeated except that the yellow pigment compound (I) was replaced with 4 parts by weight of C.I. Pigment Blue 15:3, obtaining cyan color toner particles with a weight average particle diameter of 8.1 μm.

The production of the yellow color toner particles was further repeated except that the yellow pigment compound (I) was replaced with 5 parts by weight of C.I. Pigment Red 122, obtaining magenta color toner particles with a weight average particle diameter of 8.0 μm.

The cyan color toner particles and magenta color toner particles were respectively mixed with 1.5 parts by weight of the hydrophobic fine titanium oxide powder A in the same manner as the yellow toner, obtaining cyan toner and magenta toner each having the hydrophobic fine titanium oxide particles A on the particle surfaces. The subsequent procedure was also repeated to produce a two-component cyan developer and a two-component magenta developer.

Contrast potential of the copying machine was controlled so that unfixed toner images were taken on a transfer medium (recording sheet) in a toner quantity of 1.0 $mg/cm^2$ for the yellow toner and of 0.8 $mg/cm^2$ each for the magenta toner and the cyan toner, and images were formed to output green-color fixed solid images by the use of the yellow toner and the cyan toner and to output red-color fixed solid images by the use of the yellow toner and the magenta toner.

As a method of evaluating color copied images, a method is available in which gloss (glossiness) of image surfaces and chromaticity of images are measured to judge the quality of color images. When images have a higher glossiness, the images are judged to have a color quality with a higher chromaticity (C*) as having smooth and glossy image surfaces. When, on the other hand, images have a lower glossiness, the images are judged to have coarse image surfaces with a poor chromaticity (C*) as being dull. The chromaticity "C*" is meant to be a value calculated from values of a* and b* measured by the method described below, according to the following expression:

$$C^* = \sqrt{(a^*)^2 + (b^*)^2}$$

The greater the C* is, the clearer the images are.

To measure the gloss (glossiness), a Model VG-10 glossiness meter, manufactured by Nippon Denshoku K.K., was used. In the measurement, a constant-voltage device was set to 6V, and then light projection angle and light reception angle were each adjusted to 60° C. After zero-adjustment and the setting of standard using a standard plate, the above sample images were placed on a sample stand, and three sheets of white paper were superposed thereon to carry out the measurement. Numerical values indicated at an indication area were read in a unit of %.

The color tone of the toner was quantitatively measured in accordance with the definition of the color specification system as standardized in 1976 by The Commission Internationale de l'Eclairage, Paris (CIE). More specifically, a*, b* (a* and b* are chromaticities indicating hue and chroma, respectively) and L* (brightness) were measured. A spectral calorimeter Type-938, manufactured by X-Rite Co., was used as a measuring device, and a C-light source as a light source for observation, and the visual angle was set at 2°.

In Example 1, the gloss and chromaticity of each image were as shown in Table 1 below.

TABLE 1

| Images | Toner taken | Gloss | L* | a* | b* |
|---|---|---|---|---|---|
| Yellow: | 1.0 mg/cm$^2$ | 20% | 88 | −17 | 96 |
| Cyan: | 0.8 mg/cm$^2$ | 18% | 51 | −20 | −48 |
| Magenta: | 0.8 mg/cm$^2$ | 17% | 49 | 72 | −21 |
| Green: | 1.8 mg/cm$^2$ | 28% | 44 | −60 | 19 |
| Red: | 1.8 mg/cm$^2$ | 28% | 45 | 58 | 32 |

Use of the yellow toner of the present invention brought about high brightness and chroma even in respect of the secondary color, green and red, images.

Using transparency films as a transfer medium (recording sheets), color images also were formed on the transparency films. OHP images projected through the films by means of an overhead projector (OHP) showed a good transparency.

With regard to the transparency of the OHP images in the present Example, color images formed by using the above yellow toner on the transparency film were projected using a commercially available overhead projector, and their transparency was evaluated according to the following evaluation criteria: (OHP transparency evaluation criteria)

A: Having a superior transparency, free of uneven brightness, and also having a superior color reproducibility (Good).

B: Having an uneven brightness slightly, but no problem in practical use (Passable).

C: Having an uneven brightness and having a poor color reproducibility (Failure).

Light-fastness of the yellow solid images obtained (image density: 1.70) was examined substantially according to JIS K7102. As a result, the images after 400 hours exposure to light showed almost the same image density (1.68) as those at the initial stage, and also almost no changes in hue were seen (ΔE=2.8). A carbon arc lamp was used as a light source.

With regard to the changes in hue, ΔE values were determined, and its evaluation was made quantitatively according to the following light-fastness evaluation criteria.

$$\Delta E = \{(L^*_1 - L^*_2)^2 + (a^*_1 - a^*_2)^2 + (b^*_1 - b^*_2)^2\}^{1/2}$$

$L^*_1$: Brightness of images before exposure $a^*_1$, $b^*_1$: Chromaticities indicating the hue and chroma of images before exposure $L^*_2$: Brightness of images after exposure $a^*_2$, $b^*_2$: Chromaticities indicating the hue and chroma of images after exposure (Light-fastness evaluation criteria)

A: No fading occurs even after exposure for 400 hours.

B: No fading occurs after exposure for 200 hours.

C: Fading occurs after exposure for 100 hours.

Comparative Example 1

Yellow toner 2 was prepared in the same manner as in Example 1 except that the compound (I) used therein was replaced with compound (V) represented by the following Formula (V):

(V)

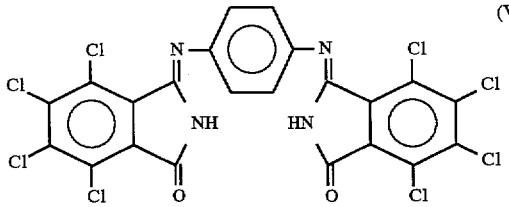

Using this yellow toner 2, evaluation was made in the same manner as in Example 1. As a result, the toner showed good image stability and charging stability in both a high temperature and high humidity environment and a low temperature and low humidity environment.

However, marks of melt-adhesion of toner were seen on the drum surface after the 50,000 sheet running carried out in a high temperature and high humidity environment and an ordinary temperature and ordinary humidity environment. Toner-spent was also seen on the carrier surfaces after the 50,000 sheet running, as confirmed by SEM.

Using the yellow toner 2, the light-fastness of yellow solid images (image density: 1.70) was also examined in the same manner as in Example 1. As a result, images after 200 hour exposure showed almost the same image density (1.68) as those at the initial stage and also almost no changes in hue were seen. However, images after further 200 hour exposure (after 400 hour exposure in total) showed a fall of image density to 1.62 and had a color difference ΔE of 6.2 compared with the initial images, showing a little fading.

Using the yellow toner 2, hues of the yellow images and secondary color, green and red images were compared in the same manner as in Example 1 (the cyan toner and magenta toner are the same as those used in Example 1). Results obtained are shown in Table 2.

TABLE 2

| Images | Toner taken | Gloss | L* | a* | b* |
|---|---|---|---|---|---|
| Yellow: | 1.0 mg/cm$^2$ | 20% | 72 | 14 | 92 |
| Green: | 1.8 mg/cm$^2$ | 28% | 42 | −36 | 40 |
| Red | 1.8 mg/cm$^2$ | 27% | 47 | 60 | 46 |

The yellow toner 2 of Comparative Example 1 was a reddish yellow toner. It showed high values in both chroma and brightness when used alone as yellow, but had so strong a reddish tone as a yellow toner for full-color images that it caused a great lowering of color reproducibility for green hue.

Comparative Example 2

Yellow toner 3 was prepared in the same manner as in Example 1 except that the compound (I) used therein was replaced with compound (VI) represented by the following Formula (VI):

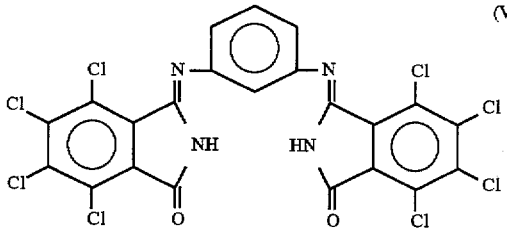

(VI)

Using this yellow toner 3, evaluation was made in the same manner as in Example 1. As a result, the toner showed a good charging stability in a low temperature and low humidity environment, but, in a high temperature and high humidity environment, charge quantity decreased with running to cause toner scattering. Fog became conspicuous after running on about 10,000 or a little more sheets, and the running test was stopped.

The drum surface of the photosensitive member after running on about 10,000 sheets was observed by SEM to find that melt-adhesion of toner had occurred and white spots corresponding to the melt-adhesion of toner were seen on the images obtained.

Using the yellow toner 3, the light-fastness of yellow solid images (image density: 1.70) was also examined in the same manner as in Example 1. As a result, images after 200 hour exposure showed almost the same image density (1.67) as those at the initial stage. However, images after further 200 hour exposure (after 400 hour exposure in total) showed a fall of image density to 1.58.

Comparative Example 3

Yellow toner 4 was prepared in the same manner as in Example 1 except that the compound (I) used therein was replaced with compound (VII) represented by the following Formula (VII):

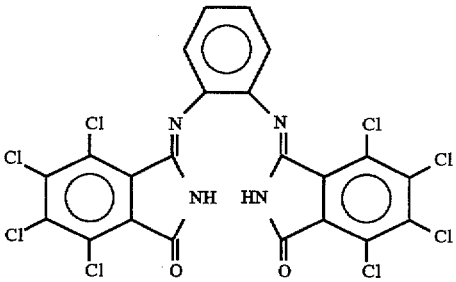

(VII)

Using this yellow toner 4, evaluation was made in the same manner as in Example 1. As a result, the toner showed a low initial-stage image density in a low temperature and low humidity environment, and, in a high temperature and high humidity environment, fogging occurred from the beginning and toner scattering began to occur with running, where the running test was stopped at 10,000 sheets.

The drum surface of the photosensitive member after running on 10,000 sheets was observed by SEM to find that melt-adhesion of toner had occurred.

Using the yellow toner 4, the light-fastness of yellow solid images (image density: 1.70) was also examined in the same manner as in Example 1. As a result, images after 100 hour exposure faded.

The transparency of OHP images was also examined to find that uneven brightness was seen and no good projected images were obtained.

Example 2

Yellow toner 5 was obtained in the same manner as in Example 1 except that the polyester resin No. 1 used therein was replaced with polyester resin No. 2 (condensation polymer of propoxylated bisphenol-A with fumaric acid; acid value: 4.0 mg KOH/g; Tg: 60° C.; Mw: 10,000; Mn: 4,200; Mw/Mn: 2.81).

Using this yellow toner 5, evaluation was made in the same manner as in Example 1. As a result, image density began to decrease after running on about 20,000 sheets in a low temperature and low humidity environment, but at a level tolerable in practical use.

Example 3

Yellow toner 6 was obtained in the same manner as in Example 1 except that the polyester resin No. 1 used therein was replaced with polyester resin No. 3 (condensation polymer of propoxylated bisphenol-A with fumaric acid; acid value: 20.2 mg KOH/g; Tg: 55° C.; Mw: 11,000; Mn: 3,800; Mw/Mn: 2.89).

Using this yellow toner 6, evaluation was made in the same manner as in Example 1. As a result, charge quantity slightly decreased in a high temperature and high humidity environment, but no problems occurred on images.

Comparative Example 4

Yellow toner 7 was obtained in the same manner as in Example 1 except that the polyester resin No. 1 used therein was replaced with polyester resin No. 4 having an acid value of 1.8 mg KOH/g.

Using this yellow toner 7, evaluation was made in the same manner as in Example 1. As a result, there was no problem in an ordinary temperature and ordinary humidity environment, but image density began to decrease after running on about 10,000 sheets in a low temperature and low humidity environment and to slightly cause fogging.

Comparative Example 5

Yellow toner 8 was obtained in the same manner as in Example 1 except that the polyester resin No. 1 used therein was replaced with polyester resin No. 5 having an acid value of 28 mg KOH/g.

Using this yellow toner 8, evaluation was made in the same manner as in Example 1. As a result, image density was high at the initial stage in an ordinary temperature and ordinary humidity environment and good results were also obtained in many-sheet running, but, in a high temperature and high humidity environment, the charge quantity of the yellow toner gradually decreased, and with a decrease thereof, image density began to increase to slightly cause toner scattering and fogging.

Comparative Example 6

Yellow toner 9 was obtained in the same manner as in Example 1 except that the polyester resin No. 1 used therein was replaced with a styrene-n-butyl acrylate copolymer No. 6 (Mw: 30,000; Mn: 9,000; Mw/Mn: 3.33; Tg: 60° C.; acid value: 0 mg KOH/g) used as the binder resin.

Using this yellow toner 9, evaluation was made in the same manner as in Example 1. As a result, good results were obtained in every environment, but, compared with the yellow toner 1 of Example 1, the toner was inferior in its color mixing with the magenta toner and cyan toner. Namely, red and green images having high chroma and brightness were not obtained.

Comparative Example 7

Yellow toner 10 was obtained in the same manner as in Example 1 except that the polyester resin No. 1 used therein was replaced with polyester resin No. 7 (combination polymer of propoxylated bisphenol-A with isophthalic acid, terephthalic acid and maleic anhydride; acid value: 11.0 mg KOH/g; Tg: 69° C.; Mw: 11,000; Mn: 4,200; Mw/Mn: 2.62).

Using this yellow toner 10, evaluation was made in the same manner as in Example 1. As a result, the toner showed a good chargeability at the initial stage of running in every environment, but all images had a low gloss. Also, in comparison with Example 1 under the same conditions for a toner-laid quantity of 1.0 mg/cm$^2$, yellow images had greatly low chroma and brightness. The results of evaluation are shown in Table 3 below.

TABLE 3

| | Gloss | L* | a* | b* |
|---|---|---|---|---|
| Yellow images: | | | | |
| Example 1 | 20% | 88 | −17 | 96 |
| Comparative Example 7 | 4% | 86 | −18 | 80 |

Images were also reproduced in a low temperature and low humidity environment. As a result, cold offset occurred on 20th sheet, and the running test was stopped.

Comparative Example 8

Yellow toner 11 was obtained in the same manner as in Example 1 except that the polyester resin No. 1 used therein was replaced with polyester resin No. 8 (condensation polymer of propoxylated bisphenol-A with fumaric acid and an alkenylsuccinic acid; acid value: 9.8 mg KOH/g; Tg: 49° C.; Mw: 10,200; Mn: 3,700; Mw/Mn: 2.76).

Using this yellow toner 11, evaluation was made in the same manner as in Example 1. As a result, in the image reproduction in an ordinary temperature and ordinary humidity environment, images adhered to the fixing roller to cause wind-around of the transfer medium after running on about 100 or a little more sheets, and the running test was stopped.

Comparative Example 9

Yellow toner 12 was obtained in the same manner as in Example 1 except that the compound (I) used therein was replaced with compound (VIII) (C.I. Pigment Yellow 74) represented by the following Formula (VIII):

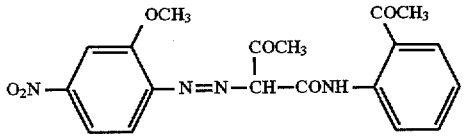

(VIII)

which was used in an amount of 7 parts by weight based on 100 parts by weight of the polyester resin.

Using this yellow toner 12, evaluation was made in the same manner as in Example 1. As a result, charge quantity of the toner began to decrease on about 5,000th sheet in many-sheet running in a high temperature and high humidity environment and also fogging began to be conspicuous. Hence, the running test was stopped.

The above compound (VIII) had a lower coloring power than the compound (I) used in Example 1, and hence the contrast potential of the full-color copying machine had to be made higher than the case of Example 1 in order to obtain images with a high image density.

Comparative Example 10

Yellow toner 13 was obtained in the same manner as in Example 1 except that the compound (I) used therein was replaced with compound (IX) (C.I. Pigment Yellow 93) represented by the following Formula (IX):

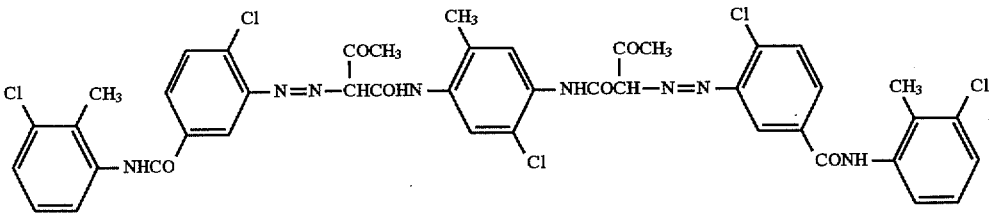

(IX)

which was used in an amount of 5 parts by weight based on 100 parts by weight of the polyester resin.

Using this yellow toner 13, evaluation was made in the same manner as in Example 1. As a result, images had a high density at the initial stage and were at a level tolerable in practical use, but the image density gradually decreased in the many-sheet running.

Light-fastness of the yellow images obtained was evaluated in the same manner as in Example 1, where the images faded (ΔE=6.3 after 100 hour exposure).

Comparative Example 11

Yellow toner 14 was obtained in the same manner as in Example 1 except that the compound (I) used therein was replaced with compound (X) (C.I. Pigment Yellow 12) represented by the following Formula (X):

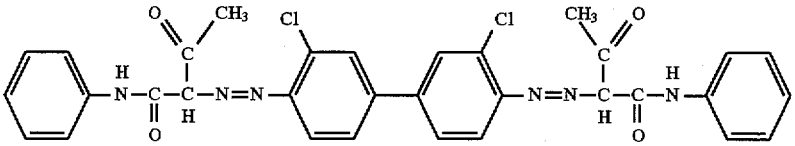

(X)

which was used in an amount of 5 parts by weight based on 100 parts by weight of the polyester resin.

Using this yellow toner 14, evaluation was made in the same manner as in Example 1. As a result, relatively stable running was performed in every environment, but the yellow images obtained faded in a light-fastness accelerated test made under exposure to a carbon-arc lamp ($\Delta E$=12 after 100 hour exposure).

Example 4

Yellow toner 15 was obtained in the same manner as in Example 1 except that the hydrophobic fine titanium oxide powder A used therein was replaced with hydrophobic fine aluminum oxide powder B having an average primary particle diameter of 0.02 μm and a hydrophobicity of 70%, obtained by subjecting 100 parts by weight of hydrophilic fine aluminum oxide powder (average primary particle diameter: 0.02 μm; BET specific surface area: 130 $m^2/g$) to surface treatment with 17 parts by weight of iso-$C_4H_9$-Si $(OCH_3)_3$.

Using this yellow toner 15, evaluation was made in the same manner as in Example 1. The toner showed a good running performance in every environment, and showed the same tendency as in Example 1 in respect of light-fastness and hues.

Comparative Example 12

Yellow toner 16 was obtained in the same manner as in Example 1 except that the hydrophobic fine titanium oxide powder A used therein was replaced with hydrophobic silica having an average primary particle diameter of 0.007 μm and a hydrophobicity of 65%, obtained by subjecting 100 parts by weight of hydrophilic silica (average primary particle diameter: 0.007 μm; BET specific surface area: 380 $m^2/g$) to surface treatment with 20 parts by weight of hexamethyldisilazane.

Using this yellow toner 16, evaluation was made in the same manner as in Example 1. The toner began to show an increase in charge quantity after running on about 2,000 or a little more sheets in a low temperature and low humidity environment, resulting in a decrease in image density, and the running test was stopped on 5,000th sheet. In the running in a high temperature and high humidity environment, the toner began to show a gradual decrease in charge quantity, so that toner scattering and fogging began to be conspicuous, and hence the running test was also stopped on 5,000th sheet.

The constitution of each toner of Examples and Comparative Examples and the results of evaluation are shown in Table 4 (Tables 4A, 4B).

Remarks for Table 4 (4B) are shown below.

*1: Running test on 10,000 sheets

*2: Running test on 5,000 sheets (1): Fogging

The state of non-image areas was visually judged.

A: Excellent

B: Good

C: Average

D: Poor (2): Toner scattering

The state inside the copying machine was visually judged.

A: Excellent

B: Good

C: Average

D: Poor (3): Running performance

The drum surface of the photosensitive member after running was observed by SEM.

A: No melt-adhesion of toner.

B: Almost no melt-adhesion.

C: Melt-adhesion was a little seen, but no problem in practical use.

D: Melt-adhesion occurred.

(4): Running performance

Toner-spent of the carrier after running was observed by SEM.

A: No problem.

B: Almost no toner-spent.

C: A little seen, but no problem in practical use.

D: Toner-spent seriously occurred.

(5): Light-fastness

A: No fading even after exposure for 400 hours.

B: No fading after exposure for 200 hours.

C: Faded after exposure for 100 hours.

(6): OHP transparency

A: Good transparency, no uneven brightness, and good color reproducibility.

B: A little uneven brightness was seen, but no problem in practical use.

C: Uneven brightness was seen, showing a poor color reproducibility.

TABLE 4A

| | Yellow toner No. | Yellow colorant, Compound | Binder resin: Type | Acid value (mg KOH/g) | Tg (°C.) |
|---|---|---|---|---|---|
| Example: 1 | Yellow toner 1 | (I) | Polyester resin No. 1 | 10.8 | 58 |
| Comparative Example: | | | | | |
| | Yellow toner 2 | (V) | Polyester resin No. 1 | 10.8 | 58 |
| 2 | Yellow toner 3 | (VI) | Polyester resin No. 1 | 10.8 | 58 |
| 3 | Yellow toner 4 | (VII) | Polyester resin No. 1 | 10.8 | 58 |
| Example: | | | | | |
| 2 | Yellow toner 5 | (I) | Polyester resin No. 2 | 4.0 | 60 |
| 3 | Yellow toner 6 | (I) | Polyester resin No. 3 | 20.2 | 55 |
| Comparative Example: | | | | | |
| 4 | Yellow toner 7 | (I) | Polyester resin No. 4 | 1.8 | 61 |
| 5 | Yellow toner 8 | (I) | Polyester resin No. 5 | 28.0 | 55 |
| 6 | Yellow toner 9 | (I) | Styrene-acrylic resin No. 6 | 0 | 60 |
| 7 | Yellow toner 10 | (I) | Polyester resin No. 7 | 11.0 | 69 |
| 8 | Yellow toner 11 | (I) | Polyester resin No. 8 | 9.8 | 49 |
| 9 | Yellow toner 12 | (VIII) | Polyester resin No. 1 | 10.8 | 58 |
| 10 | Yellow toner 13 | (IX) | Polyester resin No. 1 | 10.8 | 58 |
| 11 | Yellow toner 14 | (X) | Polyester resin No. 1 | 10.8 | 58 |
| Example: 4 | Yellow toner 15 | (I) | Polyester resin No. 1 | 10.8 | 58 |
| Comparative Example: 12 | Yellow toner 16 | (I) | Polyester resin No. 1 | 10.8 | 58 |

TABLE 4B

| | Environment of: high temperature/high humidity | | | | | Environment of: low temp./low humidity | | | | |
|---|---|---|---|---|---|---|---|---|---|---|
| | Quantity of tribo-electricity (mC/kg) | Image density | (1) | (2) | (3) | Quantity of tribo-electricity (mC/kg) | Image density | (4) | (5) | (6) |
| Example: 1 | −20 to −22 | 1.6–1.8 | A | A | A | −25 to −28 | 1.6–1.8 | A | A | A |
| Comparative Example: | | | | | | | | | | |
| 1 | −21 to −24 | 1.6–1.8 | A | A | D | −24 to −28 | 1.7–1.8 | A | B | B |
| 2 | −15 to −23*1 | 1.6–1.9*1 | D*1 | D*1 | D*1 | −23 to −28 | 1.6–1.8 | B | B | C |
| 3 | −15 to −23*1 | 1.6–1.8*1 | D*1 | D*1 | D*1 | −24 to −30 | 1.4–1.6 | B | C | C |
| Example: | | | | | | | | | | |
| 2 | −20 to −22 | 1.6–1.8 | A | A | A | −25 to −30 | 1.5–1.8 | A | A | A |
| 3 | −18 to −22 | 1.6–1.9 | B | B | A | −25 to −27 | 1.6–1.8 | A | A | A |
| Comparative Example: | | | | | | | | | | |
| 4 | −23 to −25 | 1.5–1.7 | B | A | B | −27 to −33 | 1.4–1.6 | B | A | B |
| 5 | −18 to −23 | 1.6–1.9 | D | C | D | −29 to −31 | 1.5–1.7 | B | A | A |
| 6 | −20 to −24 | 1.4–1.6 | B | B | C | −27 to −34 | 1.4–1.6 | B | B | C |
| 7 | | Not tested | | | | Cold offset on 20th sheet | | | A | C |
| 8 | | Not tested | | | | Not tested | | | B | A |
| 9 | −26 to −30*2 | 1.2–1.4*2 | D*2 | D*2 | B*2 | −32 to −36 | 1.2–1.3 | C | C | C |
| 10 | −22 to −29 | 1.2–1.6 | C | C | B | −26 to −34 | 1.1–1.4 | D | C | C |
| 11 | −20 to −23 | 1.5–1.7 | C | C | B | −25 to −32 | 1.3–1.5 | C | C | A |
| Example: 4 | −20 to −22 | 1.6–1.8 | A | A | A | −24 to −28 | 1.6–1.8 | A | A | A |
| Comparative Example: 12 | −15 to −22*2 | 1.5–1.9*2 | D*2 | D*2 | A*2 | −24 to −36*2 | 1.3–1.8*2 | C*2 | A | A |

What is claimed is:

1. A yellow toner for developing an electrostatic image, comprising yellow color toner particles having at least a binder resin and a yellow colorant, and an external additive, wherein;

said binder resin has a polyester resin having an acid value of from 2 mg KOH/g to 25 mg KOH/g and a glass transition temperature of from 52° C. to 65° C.;

said yellow colorant has a compound represented by the following Formula (I):

(I)

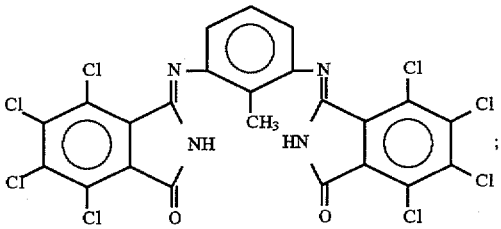

said external additive has a fine titanium oxide powder or fine aluminum oxide powder subjected to hydrophobic treatment, having an average primary particle diameter of from 0.01 μm to 2 μm; and said yellow toner has a weight average particle diameter of from 3.0 μm to 15.0 μm.

2. The yellow toner according to claim 1, wherein said yellow color toner particles contain said compound represented by Formula (I) in an amount of from 1 part by weight to 15 parts by weight based on 100 parts by weight of said binder resin.

3. The yellow toner according to claim 1, wherein said polyester resin has an acid value of from 3 mg KOH/g to 22 mg KOH/g.

4. The yellow toner according to claim 1, wherein said polyester resin has an acid value of from 5 mg KOH/g to 20 mg KOH/g.

5. The yellow toner according to claim 1, wherein said polyester resin has a number average molecular weight Mn of from 1,500 to 50,000, a weight average molecular weight Mw of from 6,000 to 100,000, and Mw/Mn of from 2 to 8.

6. The yellow toner according to claim 1, wherein said polyester resin has a number average molecular weight Mn of from 2,000 to 20,000, a weight average molecular weight Mw of from 10,000 to 90,000, and Mw/Mn of from 2 to 8.

7. The yellow toner according to claim 1, wherein said yellow color toner particles further contain a metal compound of an aromatic carboxylic acid derivative.

8. The yellow toner according to claim 7, wherein said metal compound of an aromatic carboxylic acid derivative is colorless, white or light-colored.

9. The yellow toner according to claim 1, which has a negative chargeability.

10. The yellow toner according to claim 1, wherein said yellow color toner particles further contain a release agent.

11. The yellow toner according to claim 1, which has a weight average particle diameter of from 4.0 μm to 12.0 μm.

12. The yellow toner according to claim 1, which has a volume average particle diameter of from 2.5 μm to 6.0 μm.

13. The yellow toner according to claim 1, wherein said fine titanium oxide powder or fine aluminum oxide powder subjected to hydrophobic treatment has an average primary particle diameter of from 0.01 μm to 0.2 μm.

14. The yellow toner according to claim 1, wherein said fine titanium oxide powder or fine aluminum oxide powder subjected to hydrophobic treatment is contained in an amount of from 0.5% by weigh to 5.0% by weight based on the weight of the yellow toner.

15. The yellow toner according to claim 1, which is used as a one-component developer.

16. A two-component developer comprising; a yellow toner and a carrier;

said yellow toner comprising yellow color toner particles having at least a binder resin and a yellow colorant, and an external additive, wherein;

said binder resin has a polyester resin having an acid value of from 2 mg KOH/g to 25 mg KOH/g and a glass transition temperature of from 52° C. to 65° C.;

said yellow colorant has a compound represented by the following Formula (I):

(I)

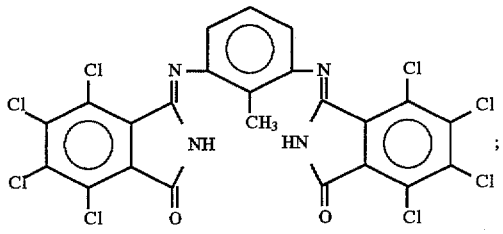

said external additive has a fine titanium oxide powder or fine aluminum oxide powder subjected to hydrophobic treatment, having an average primary particle diameter of from 0.01 μm to 2 μm;

said yellow toner has a weight average particle diameter of from 3.0 μm to 15.0 μm; and said carrier comprises magnetic carrier particles.

17. The two-component developer according to claim 16, wherein said magnetic carrier particles comprise magnetic particles of a material selected from the group consisting of a magnetic metal, an alloy of the magnetic metal, an oxide of the magnetic metal and a magnetic ferrite of the magnetic metal.

18. The two-component developer according to claim 16, wherein said magnetic carrier particles comprise a coated carrier having said magnetic particles as carrier cores whose surfaces are coated with a coating agent.

19. The two-component developer according to claim 18, wherein said coating agent is selected from the group consisting of polytetrafluoroethylene, monochlorotrifluoroethylene polymer, polyvinylidene fluoride, silicone resin, polyester resin, styrene resin, acrylic resin, polyamide, polyvinyl butyral and aminoacrylate resin.

20. The two-component developer according to claim 16, wherein said carrier has an average particle diameter of from 10 μm to 100 μm.

21. The two-component developer according to claim 16, wherein said carrier has an average particle diameter of from 20 μm to 70 μm.

22. The two-component developer according to claim 16, wherein said yellow toner is contained in the two-component developer in an amount of from 2% by weight to 15% by weight based on the weight of the two-component developer.

23. The two-component developer according to claim 16, wherein said yellow color toner particles contain said compound represented by Formula (I) in an amount of from 1 part by weight to 15 parts by weight based on 100 parts by weight of said binder resin.

24. The two-component developer according to claim 16, wherein said polyester resin has an acid value of from 3 mg KOH/g to 22 mg KOH/g.

25. The two-component developer according to claim 16, wherein said polyester resin has an acid value of from 5 mg KOH/g to 20 mg KOH/g.

26. The two-component developer according to claim 16, wherein said polyester resin has a number average molecular weight Mn of from 1,500 to 50,000, a weight average molecular weight Mw of from 6,000 to 100,000, and Mw/Mn of from 2 to 8.

27. The two-component developer according to claim 16, wherein said polyester resin has a number average molecular weight Mn of from 2,000 to 20,000, a weight average molecular weight Mw of from 10,000 to 90,000, and Mw/Mn of from 2 to 8.

28. The two-component developer according to claim 16, wherein said yellow color toner particles further contain a metal compound of an aromatic carboxylic acid derivative.

29. The two-component developer according to claim 28, wherein said metal compound of an aromatic carboxylic acid derivative is colorless, white or light-colored.

30. The two-component developer according to claim 16, wherein said yellow toner has a negative chargeability.

31. The two-component developer according to claim 16, wherein said yellow color toner particles further contain a release agent.

32. The two-component developer according to claim 16, wherein said yellow toner has a weight average particle diameter of from 4.0 μm to 12.0 μm.

33. The two-component developer according to claim 16, wherein said yellow toner has a volume average particle diameter of from 2.5 μm to 6.0 μm.

34. The two-component developer according to claim 16, wherein said fine titanium oxide powder or fine aluminum oxide powder subjected to hydrophobic treatment has an average primary particle diameter of from 0.01 μm to 0.2 μm.

35. The two-component developer according to claim 16, wherein said fine titanium oxide powder or fine aluminum oxide powder subjected to hydrophobic treatment is contained in an amount of from 0.5% by weigh to 5.0% by weight based on the weight of the yellow toner.

36. An image sheet comprising:

a recording sheet; and a color image formed on the recording sheet by fixing on the recording sheet a color toner image having at least a yellow toner;

said yellow toner comprising yellow color toner particles having at least a binder resin and a yellow colorant, and an external additive, wherein:

said binder resin has a polyester resin having an acid value of from 2 mg KOH/g to 25 mg KOH/g and a glass transition temperature of 52° C. to 65° C.;

said yellow colorant has a compound represented by the following Formula (I):

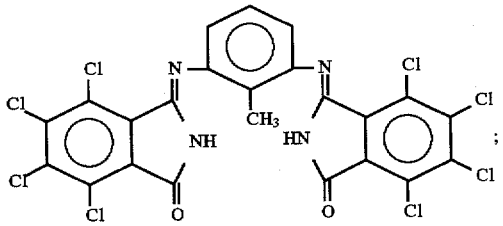

(I)

;

said external additive has a fine titanium oxide powder or fine aluminum oxide powder subjected to hydrophobic treatment, having an average primary particle diameter of from 0.01 μm to 2 μm; and said yellow toner has a weight average particle diameter of from 3.0 μm to 15.0 μm.

37. The image sheet according to claim 36, wherein said yellow color toner particles contain said compound represented by Formula (I) in an amount of from 1 part by weight to 15 parts by weight based on 100 parts by weight of said binder resin.

38. The image sheet according to claim 36, wherein said polyester resin has an acid value of from 3 mg KOH/g to 22 mg KOH/g.

39. The image sheet according to claim 36, wherein said polyester resin has an acid value of from 5 mg KOH/g to 20 mg KOH/g.

40. The image sheet according to claim 36, wherein said polyester resin has a number average molecular weight Mn of from 1,500 to 50,000, a weight average molecular weight Mw of from 6,000 to 100,000, and Mw/Mn of from 2 to 8.

41. The image sheet according to claim 36, wherein said polyester resin has a number average molecular weight Mn of from 2,000 to 20,000, a weight average molecular weight Mw of from 10,000 to 90,000, and Mw/Mn of from 2 to 8.

42. The image sheet according to claim 36, wherein said yellow color toner particles further contain a metal compound of an aromatic carboxylic acid derivative.

43. The image sheet according to claim 42, wherein said metal compound of an aromatic carboxylic acid derivative is colorless, white or light-colored.

44. The image sheet according to claim 36, wherein said yellow toner has a negative chargeability.

45. The image sheet according to claim 36, wherein said yellow color toner particles further contain a release agent.

46. The image sheet according to claim 36, wherein said yellow toner has a weight average particle diameter of from 4.0 μm to 12.0 μm.

47. The image sheet according to claim 36, wherein said yellow toner has a volume average particle diameter of from 2.5 μm to 6.0 μm.

48. The image sheet according to claim 36, wherein said fine titanium oxide powder or fine aluminum oxide powder subjected to hydrophobic treatment has an average primary particle diameter of from 0.01 μm to 0.2 μm.

49. The image sheet according to claim 36, wherein said fine titanium oxide powder or fine aluminum oxide powder subjected to hydrophobic treatment is contained in an amount of from 0.5% by weigh to 5.0% by weight based on the weight of the yellow toner.

* * * * *

UNITED STATES PATENT AND TRADEMARK OFFICE

CERTIFICATE OF CORRECTION

PATENT NO. : 5,750,298

DATED : May 12, 1998

INVENTOR(S): MAKOTO KANBAYASHI ET AL.

It is certified that error appears in the above-identified patent and that said Letters Patent is hereby corrected as shown below:

Title page, item [54] and col. 1, in the title

"TWO" should read -- TWO- -- and "DEVELOPER" should read --DEVELOPER, AND--.

COLUMN 1

Line 2, "TWO" should read -- TWO- --;
Line 3, "DEVELOPER," should read --DEVELOPER, AND--;
Line 16, "permeating" should read --spreading--;
Line 26, "a a" should read --a--;
Line 40, "complimentary" should read --complementary--.

COLUMN 2

Line 11, "adhere" should read --adhere to--;
Line 18, "tend" should read --tends--.

COLUMN 3

Line 34, "wherein;" should read --wherein:--.

COLUMN 4

Line 26, "wherein;" should read --wherein:--;
Line 63, "has" should read --have--.

UNITED STATES PATENT AND TRADEMARK OFFICE

CERTIFICATE OF CORRECTION

PATENT NO. : 5,750,298

DATED : May 12, 1998

INVENTOR(S): MAKOTO KANBAYASHI ET AL.

It is certified that error appears in the above-identified patent and that said Letters Patent is hereby corrected as shown below:

COLUMN 6

Line 17, "inter action" should read --interaction--;
Line 34, "and" should be deleted.

COLUMN 7

Line 37, "have" should read --has--;
Line 40, "resins" should read --resin--;
Line 61, "resing" should read --resin--;
Line 67, "lible" should read --liable--.

COLUMN 8

Line 12, "form" should read --from--.

COLUMN 9

Line 7, "is" should read --are--;
Line 29, "a" should read --an--

COLUMN 10

Line 46, "power" should read --powder-- and "embeded" should read --embedded--;
Line 54, "imbeded" should read --embedded--.

UNITED STATES PATENT AND TRADEMARK OFFICE

CERTIFICATE OF CORRECTION

PATENT NO. : 5,750,298

DATED : May 12, 1998

INVENTOR(S): MAKOTO KANBAYASHI ET AL.

It is certified that error appears in the above-identified patent and that said Letters Patent is hereby corrected as shown below:

COLUMN 12

Line 57, "an" should read --a--.

COLUMN 13

Line 50, "drum Sa" should read --drum 5a--.

COLUMN 15

Line 7, "Measurement" should read --¶ Measurement--.

COLUMN 16

Line 8, delete "of";
Line 31, "Measurement" should read --¶ Measurement--.

COLUMN 18

Line 19, "an" should be deleted.

COLUMN 19

LINE 21, "calorimeter" should read --colorimeter--;
Line 48, "(OHP" should read --¶ (OHP--.

UNITED STATES PATENT AND TRADEMARK OFFICE

CERTIFICATE OF CORRECTION

PATENT NO. : 5,750,298

DATED : May 12, 1998

INVENTOR(S): MAKOTO KANBAYASHI ET AL.

It is certified that error appears in the above-identified patent and that said Letters Patent is hereby corrected as shown below:

COLUMN 20

Line 6, "(Light-fastness" should read --¶ (Tight-fastness--.

COLUMN 27

Table 4A, "Comparative Example:

2"

should read --Comparative Example:

1
2--;

Line 66, "wherein;" should read --wherein:--.

COLUMN 29

Line 55, "weigh" should read --weight--;
Line 59, "comprising;" should read --comprising:--
Line 63, "wherein;" should read --wherein:--.

UNITED STATES PATENT AND TRADEMARK OFFICE

CERTIFICATE OF CORRECTION

PATENT NO. : 5,750,298

DATED : May 12, 1998

INVENTOR(S): MAKOTO KANBAYASHI ET AL.

It is certified that error appears in the above-identified patent and that said Letters Patent is hereby corrected as shown below:

COLUMN 31

Line 26, "weigh" should read --weight--;
Line 35, "wherein:" should read --wherein--.

COLUMN 32

Line 48, "weigh" should read --weight--.

Signed and Sealed this

Ninth Day of February, 1999

*Attest:*

*Acting Commissioner of Patents and Trademarks*

*Attesting Officer*